United States Patent [19]

Newcomb

[11] Patent Number: 4,593,289

[45] Date of Patent: Jun. 3, 1986

[54] MULTI-BAND DIPOLE ANTENNA WITH MATCHING STUBS

[75] Inventor: Donald R. Newcomb, San Marcos, Tex.

[73] Assignee: Butternut Electronics Co., Lockhart, Tex.

[21] Appl. No.: 485,875

[22] Filed: Apr. 18, 1983

[51] Int. Cl.[4] ..... H01Q 9/28

[52] U.S. Cl. ..... 343/795; 343/818; 343/747

[58] Field of Search ..... 343/795, 803, 806–809, 343/831, 722, 745, 747, 748, 749, 817–819, 750, 810, 825, 826, 834

[56] References Cited

U.S. PATENT DOCUMENTS

| | | | |
|---|---|---|---|
| 2,175,253 | 10/1939 | Carter | 343/795 |
| 2,440,597 | 4/1948 | Atwood, Jr. | 343/807 |
| 2,591,790 | 4/1952 | Denson | 343/795 |
| 2,640,934 | 6/1953 | Lago | 343/795 |
| 2,949,607 | 8/1960 | Lamb | 343/722 |
| 3,646,566 | 2/1972 | Neff, Jr. | 343/808 |
| 4,161,737 | 7/1979 | Albright | 343/895 |

OTHER PUBLICATIONS

"The ARRL Antenna Book", Published by the American Radio Relay League, Newington, Conn., 14th Edition, 1983, pp. 5-14–5-18, 9-4–9-6.

*Primary Examiner*—Eli Lieberman

*Assistant Examiner*—Michael C. Wimer

*Attorney, Agent, or Firm*—Hugh D. Jaeger

[57] ABSTRACT

Antenna for operation on a plurality of frequencies, the antenna including apex fed opposing swept elements and a plurality of stubs parallel to a central element, a plurality of capacitors connected between one end of the central element and ends of the stubs, and a coaxial cable connected to the opposing swept elements. Each swept element is of a triangular configuration with a central element running from the apex to the base of the triangle at a substantially perpendicular intersection. A plurality of matching stubs connect from the coaxial fed apex and substantially parallel along the central tube, secured at the other end with clamps or capacitors. Ceramic doorknob capacitors connect between the coaxial fed apex and a free end of the first stub and between the first and second stub ends. A hairpin coil can be utilized between the apex feed and the first capacitor, providing required circuit Q. A matching end can connect across the feedpoint at a common matching stub point for the swept elements. A plurality of apex fed opposing swept elements positioned on a boom and supported by a mast provides a beam antenna when using a driven element and a reflector element, and additionally a director element as desired. The antenna can be structured to operate on a plurality of frequencies such as 20 meters, 15 meters and 10 meters in the amateur radio spectrum or on any other frequencies as desired in the HF or higher spectrum.

15 Claims, 4 Drawing Figures

MULTI-BAND DIPOLE ANTENNA WITH MATCHING STUBS

BACKGROUND OF THE INVENTION

1. Field of the Invention

The present invention pertains to an antenna and, more particularly, pertains to at least a swept element and at least three-frequency antenna for utilization in the amateur radio frequency spectrum, the military frequency spectrum, the HF spectrum or the professional communications frequency spectrum.

2. Description of Prior Art

The prior art triband beam antennas have been complex mechanical structures requiring traps for resonance on predetermined designated frequencies. The prior art beam antennas and antennas in general have usually been extremely large in size, mechanically and electrically, and also expensive to the individual user due to the amount of metal and electrical circuitry in the tune traps of the beam antenna. The resultant beam antenna was a large mechanical structure, an electrical structure with traps which had inherent problems either of opening up or burning shorted, and an antenna while realistically used had a limited life due to mechanical and electrical failures in the traps.

Also, another problem with the beam antennas was matching the antenna with a desired coaxial impedance, having a wide bandwidth, having a determined usable resonant center frequency, and having a structure which was mechanically rotatable. Prior art structures required large size arrays.

The present invention overcomes the disadvantages of the prior art by providing an apex fed opposing swept element beam antenna which can also be utilized as a monopole or dipole antenna and which includes a relatively reduced physical size of antenna with a minimal reduction in bandwidth, and an antenna which is not mechanically or electrically broken for traps as known in the prior art.

SUMMARY OF THE INVENTION

The general purpose of the present invention is to provide an apex fed opposing swept element beam antenna for operation on a plurality of frequencies such as 20 meters, 15 meters, and 10 meters, and utilizing elements which are of reduced short and physical structure with a minimal reduction in bandwidth. The antenna utilizes a flat-top rod base of an inverted triangle for a monopole configuration providing the fundamental operating theory, and providing an antenna which has high efficiency and maximum bandwidth in that the radiator is radiating on all frequencies. Futher, the antenna as a dipole is electrically concurrent and is not electrically or mechanically isolated as in the prior art.

According to one embodiment of the present invention, there is provided an apex fed opposing swept dipole element including cylindrical fiberglass rod support, a right and left central tubular element extending therefrom secured with nut-and-bolt assemblies, a right end rod element and a left end rod element secured at substantially right angles to the outer ends of the central tubular elements with a clamp and nut-and-bolt assembly, upper and lower right swept rod elements and upper and lower left swept rod elements, and clamps securing the outer ends of the swept rod elements to the upper and lower ends of the end rod elements with clamp and nut-and-bolt assemblies, and the inner ends of the swept rod elements are secured to the inner end of the central tubular elements adjacent the fiberglass rod support with clamp and nut-and-bolt assemblies, upper left and right stubs, upper left and right shorting clamps at the outer end of the stubs and secured between the outer ends of the stubs and to a mid portion of the central tubular element with clamps and nut-and-bolt assemblies, right and left dielectric supports securing the inner ends of the stubs to the inner end of the central tubular element, a right and left capacitor such as a ceramic doorknob capacitor secured along with an inductance coil between the inner end of the central tubular elements and the inner end of the first stubs, and lower second right and left stubs, a shorting clamp between each inner end of the second stub and an inner end of the first stub, a left and right ceramic doorknob capacitor connected between the outer ends of the first and second upper and lower left and right stubs, and a coaxial feedline connected between the feed points of the two opposing apex fed swept elements. At the junction of the inner ends of the first stubs tied to a lower end of the ceramic capacitor of the first stub and the inner ends of the first and second lower stubs, a hairpin inductor coil can connect across the feedpoint.

The antenna can be utilized as a directional array with a plurality of elements including at least a reflector element and can also include a plurality of director elements in addition to the driven element.

One significant aspect and feature of the present invention is that the apex fed opposing swept element antenna can be utilized as either a monopole or a dipole, or a directional array with more than one element.

Another significant aspect and feature of the present invention is an antenna which is not mechanically or electrically broken and not utilizing loading coils or traps, thereby providing an unusually high efficiency and bandwidth.

A further significant aspect and feature of the present invention is an antenna which provides that a parasitic director can be utilized with closer than normal spacing to produce an improved front-to-back ratio without sacrificing significant gain.

An additional significant aspect and feature of the present invention is an antenna which mechanically and electrically is reduced in size to comparable prior art antennas.

Having thus described embodiments of the present invention, it is a principal object hereof to provide an apex fed opposing swept element antenna in either a monopole, dipole, or beam array configuration.

One object of the present invention is an antenna with apex fed opposing swept elements providing unusually high efficiency antenna with maximum bandwidth, and a physical and electrical reduction in antenna length based on the theory that the support structure is not electrically and mechanically broken for coiled trap inductors.

Another object of the present invention is an apex fed opposing swept element array providing broad band coverage with a flat-top rod of a base of an inverted triangle.

BRIEF DESCRIPTION OF THE DRAWINGS

Other objects and many of the attendant advantages of the present invention will be readily understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
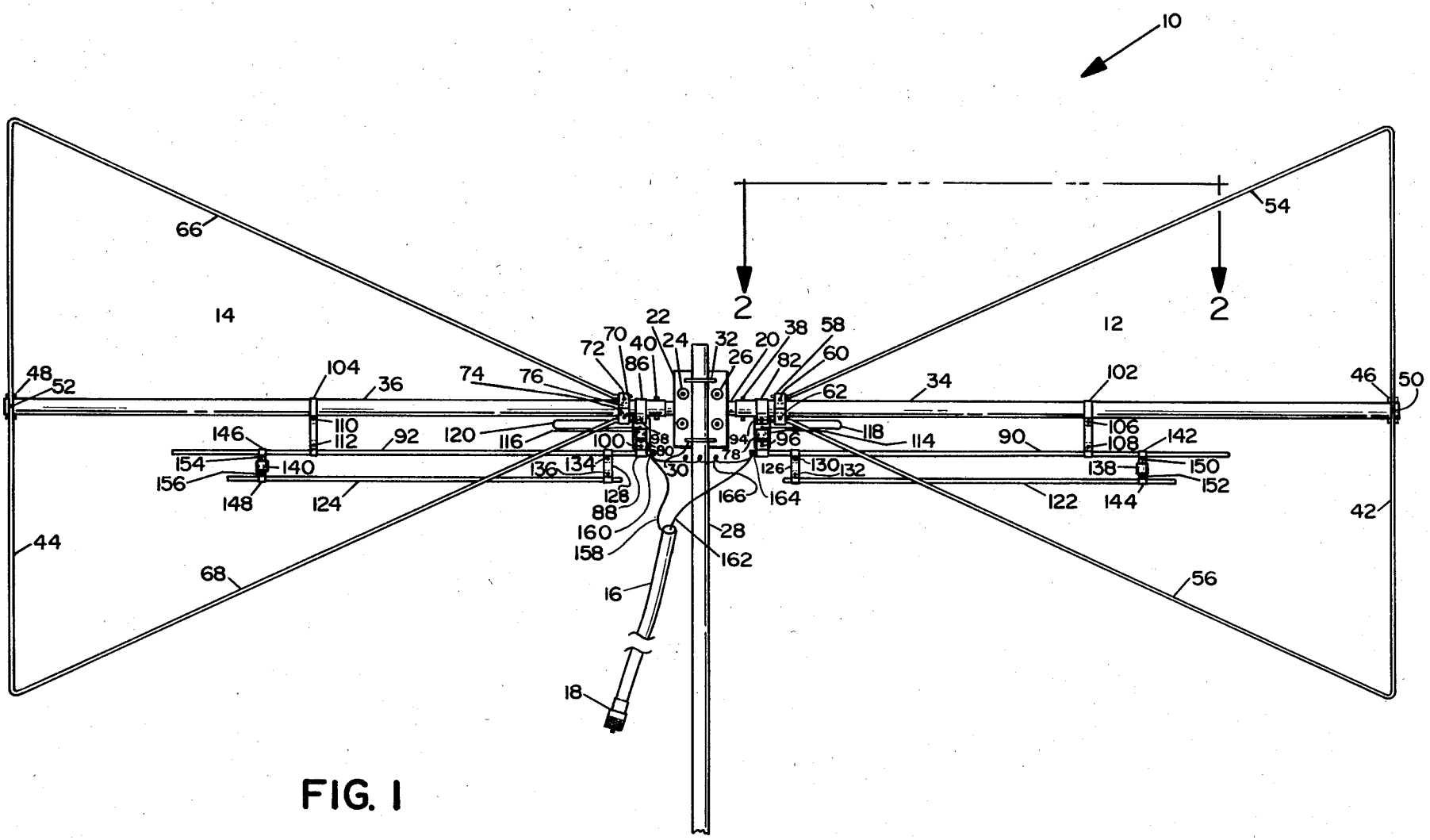
FIG. 1 illustrates a dipole configuration of an apex fed opposing swept element antenna.

FIG. 1 illustrates a plan view of an antenna 10, the present invention, illustrating a dipole configuration of an apex fed opposing swept element antenna including a right swept element assembly 12, a left swept element assembly 14, a coaxial feedline 16 connected between the assemblies 12 and 14 as later described in detail through a coaxial connector 18 or the like.

The right element assembly 12 and left element assembly 14 are supported about a cylindrical fiberglass rod support 20, the rod support 20 secured to a mast support 22 with two U-bolt assemblies 24 and 26, mast support 22 then secured to a boom 28 with two U-bolt assemblies 30 and 32. The U-bolt assemblies include U-bolts, washers, lock washers, and nuts which are not numbered or detailed, for the sake of brevity in this disclosure.

Figure 3:
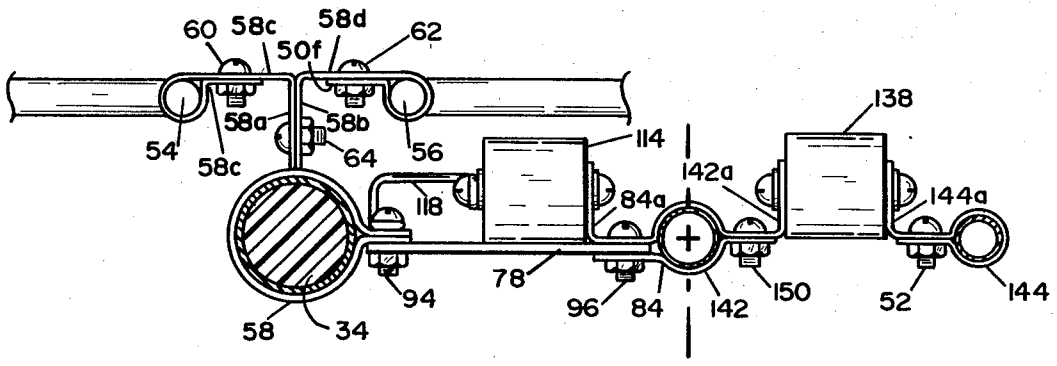
FIG. 3 illustrates an end view taken along line 3—3 of FIG. 2.

A right central tubular member 34 and a left central tubular member 36 telescope over opposing ends of the cylindrical fiberglass rod support 20, and are secured thereto with nut-and-bolt assemblies 38 and 40 respectively. A right end rod element 42 and a left end rod element 44 secure to the outer ends of the central tubular elements 34 and 36 with clamps 46 and 48 and nut-and-bolt assemblies 50 and 52. An upper right swept rod element 54 and a lower right swept rod element 56 extend from the opposing ends of the element 42 to the inner end of the central tubular element 34 and are appropriately secured with clamp 58, as also illustrated in FIG. 3, and nut-and-bolt assemblies 60, 62 and 64 of FIG. 3. These swept elements can be provided either with a slight curvature or can be substantially straight. A swept element is defined as an element extending outwardly from a common feed point junction at a center of dipole elements with respect to a dipole plane. A swept element also forms an equiangular element configuration. Upper and lower swept elements sweep from the feed point junction of the dipole elements outwardly toward an end element in a triangular fashion. Likewise, an upper left swept rod element 66 and a lower left swept rod element 68 are secured with wrap-around configured clamp 70 and nut-and-bolt assemblies 72, 74 and 76. Right and left dielectric supports 78 and 80 secure between the inner ends of the central tubular elements 34 and 36 respectively and between the inner ends of upper right stub and upper left stubs 90 and 92 with clamps 82, 84, 86 and 88 with nut-and-bolt assemblies 94, 96, 98 and 100. Upper right and upper left shorting clamps 102 and 104 secure between the outer end portion of the stubs 82 and 84 and mid portion of the central tubular elements 34 and 36 with nut-and-bolt assemblies 106, 108, 110 and 112. Upper right and upper left capacitors 114 and 116 such as ceramic doorknob capacitors or the like are supported on the dielectric supports 78 and 80 and electrically connect one end to the inner end of the stubs 82 and 84. Inductor coils 118 and 120, which in this instance are hairpin coils or extended pieces of wire, connect from nut-and-bolt assemblies 94 and 98 to the other end of the dielectric capacitors. The ceramic doorknob capacitors in this particular example include bolt and washer connection for facilitating connections between the stubs and the coil members. A lower right stub 122 and a lower left stub 124 of a slightly shorter length than the stubs 90 and 92 position below the stubs 90 and 92. A lower right shorting clamp 126 and a lower left shorting clamp 128 connect between the end of the stubs 122 and 124 and the stubs 90 and 92 with nut-and-bolt assemblies 130, 132, 134 and 136. A lower right capacitor 138 and a lower left capacitor 140 electrically connect between the approximate ends of the respective stubs 122 126 and 90 82, and 124 and 92 with right-angle encompassing clamps 142, 144, 146 and 148 with bolts 150, 152, 154 and 156 secured through the clamps to the internal threads of the capacitors 138 and 140. The coaxial line 16, connected to the coaxial connector 18, connects the outer conductor 158 of the coaxial cable to 16 and the inner conductor 162 of the coaxial cable 16 at feedpoints 160 and 164. A hairpin coil 166 can be provided between the feedpoints for impedance matching.

Figure 2:
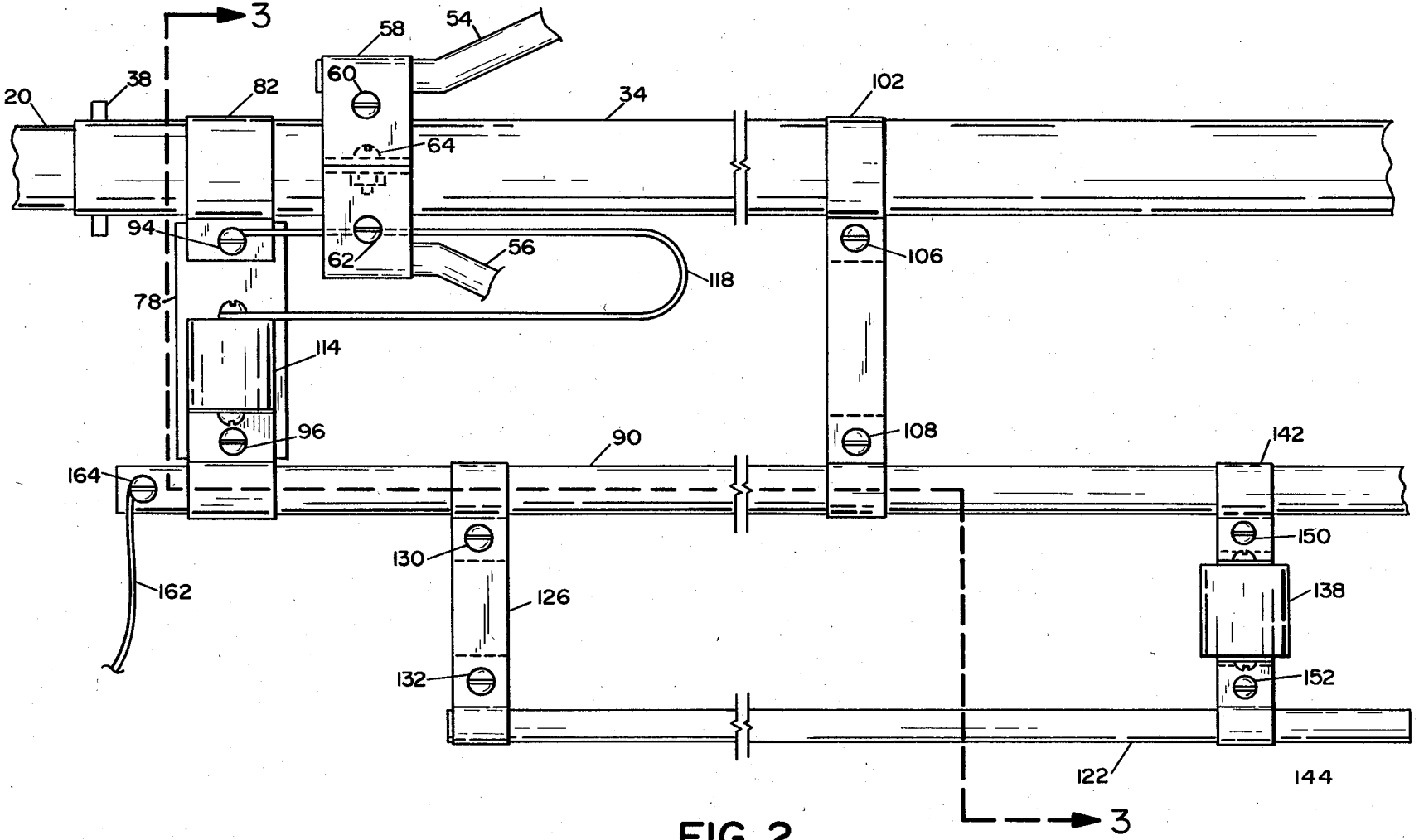
FIG. 2 illustrates an enlarged view of the apex feed point and stub tuning structure taken along line 2—2 of FIG. 1.

FIG. 2 illustrates an enlarged view of the feedpoint area about the apex fed opposing swept element assemblies 12 and 14. The particular detail of the capacitors 114 and 116 and 138 and 140 and the hairpin inductor coils 118 and 120 is illustrated. The mechanized clamps are "wrap-around" element clamps with right-angle bends as required. The stubs 90, 92, 122 and 124 can be in an angular plane to the plane of the swept elements, providing for clearance of the hairpin coils 118 and 120 and the stubs. Sufficient clearance is provided as illustrated in FIG. 3 and there is no interreactance on the amateur frequencies.

FIG. 3 illustrates a view taken along line 3—3 of FIG. 2 where all numerals correspond to those elements previously described. Particular attention is noted to the wrap-around clamps encompassing the circumferential area about the elements and including a sufficient overlap for securing by nut-and-bolt assemblies where appropriate or directly to the appropriate end of the tubular ceramic doorknob high-voltage capacitors. This particular bending of the clamps as well as utilization of a single bolt to each end of the tubular capacitor provides for a least number of mechanical components with assured structural integrity and stability of the matching stubs.

FIG. 3 particularly shows the orientation of the dielectric support 78 connected between the two clamps 82 and 84 secured thereto with nut-and-bolt assemblies 94 and 96. The capacitor 114 connects onto a right-angle lip 84*a* of clamp 84 with a bolt and washer at one end. The other end connects with a bolt and washer to the end of the hairpin coil 118. This provides an inductor 118-capacitor 114 connection between the central element 34 and the upper stub 82. The lower stub 122 positions with the clamp 126 and nut-and-bolt assemblies 130 and 132 at one end; and, by the wrap-around clamps 142 and 144 with right-angle lips 142*a* and 144, bolts 150 and 152 to the capacitor 138.

Clamp 58 can be described as a wrap-around clamp with a right-angle bend, a second and opposing wrap-around bend with lips extending therefrom where the right-angle bend is secured by nut-and-bolt assembly 64, and the lips are secured by nut-and-bolt assemblies 60 and 62. The dielectric member can be any suitable plastic, Teflon or the like. Clamp 84 is configured as a wrap-around with a lip and with space for accommodating the dielectric insulator 78. Clamps 142 and 144 are wrap-around including securing by nut-and-bolt assemblies 150 and 152 and including lips 142*a* and 144*a* for securing the tubular capacitor there-between with suitable bolts and washers. Clamp 58 includes vertical extending members 58*a* and 58*b*, horizontal extending members 58*c* and 58*d*, and wrap-around members 58*e* and 58*f* about the elements 54 and 56.

MODE OF OPERATION

The apex fed opposing swept element antenna 10 can be constructed with 1.125" aluminum tubing for the central support tubular elements 34 and 36 with surrounding 3/16" rod for the end rod elements 42 and 44 and the upper and lower right and left swept elements. The gamma rods 90 and 92 and 122 and 124 can also be 3/16" rod or ⅛" tubing.

This particular antenna lends itself to operation in the amateur radio frequencies at 20 meters, 15 meters, and 10 meters. The antenna provides a substantially flat standing wave ratio over a 600 Khz portion of the frequencies where the wing span is about twelve feet. The parasitic director provides closer than normal spacing with significant better front-to-back ratio without sacrificing gain over the prior art antennas. The element size is approximately and substantially one-third that of the prior art antennas. The tubular ceramic doorknob capacitors are 67 pf capacitors or an equivalent value.

At 20 meters, the wing span is approximately twelve to thirteen feet. A quarter-wave matching line may be required and can be utilized of 75 ohm coaxial cable between the feed line and the feed point depending upon the output of the transmitter.

The theory of the apex fed opposing swept element antenna design can be described as a first parallel circuit of inductance-capacitance and a second parallel circuit tapped across the inductance of the first parallel circuit. The first stubs 90 and 92 provide resonance on 10 meters and 20 meters with a second resonant at 10 meters. The second stubs 122 and 124 provide for resonance at 15 meters.

ALTERNATIVE EMBODIMENT OF DIRECTIONAL ARRAY ANTENNA

Figure 4:
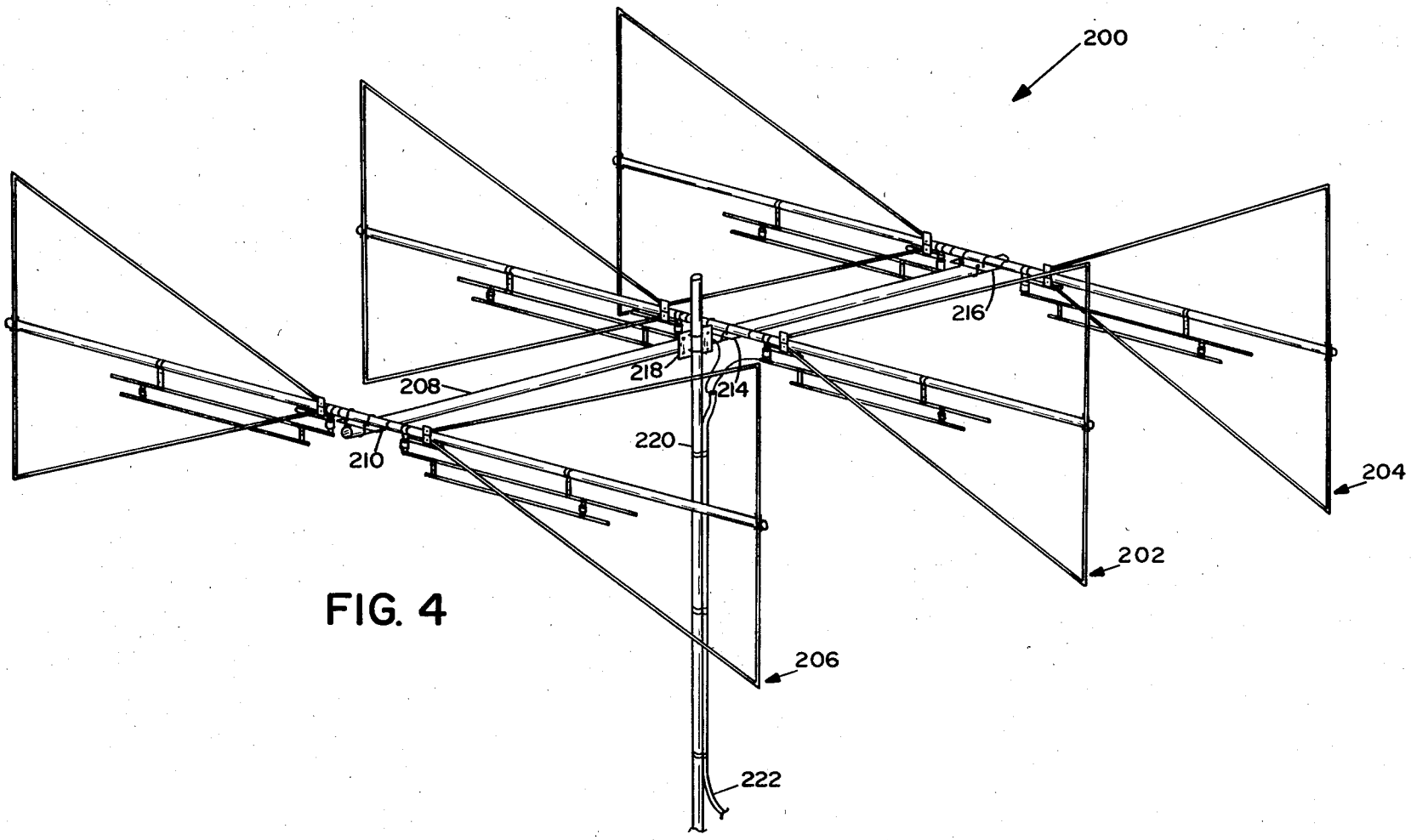
FIG. 4 illustrates a perspective view of a beam array utilizing a reflector, driven element, and director of the apex fed opposing swept element dipoles.

FIG. 4 illustrates a perspective view of a beam antenna 200 including a driven element 202, a reflector element 204, and a director element 206, where all of the elements are apex fed opposing swept elements as previously disclosed in FIGS. 1–3.

The elements 202–206 are supported on a boom 208 with boom supporting plates 210, 214 and 216 with U-bolt assemblies securing the center insulator of each element to the boom plate, and U-bolt assemblies securing the boom plate to the boom 208. A mast support 218 secures the boom 208 to the mast 220 with U-bolt assemblies.

Each apex fed opposing swept element including the driven element, the director element, and the reflector element is physically identical or substantially identical where the amount of inductance added to the L-C circuit provides that one of the designated elements can be a director by high tuning the element and the other element can be a reflector element by low tuning the element. By appropriately adjusting the inductance, the element designation is accordingly. A coaxial feedline 222 connects to the driven element 202 as previously described for coupling of radio frequency energy to the driven element.

Various modifications can be made to the present invention without departing from the apparent scope thereof. All of the antenna elements can be the same size with the fact that the amount of stub may be lengthened or shortened to adjust the element accordingly for utilization as a director or reflector, which is about 5%–10% higher or lower in resonance respectively. This is particularly so when operating on the 15- and 20-meter frequencies. On the 10-meter frequency, it is foreseeable to not utilize the hairpin coil in order to cause the element to resonate as a director or to lengthen it as a reflector element. Also, any suitable capacitor can be utilized in lieu of the doorknob capacitor such as a tubular ceramic capacitor, ceramic capacitors, and other capacitors.

The antenna can utilize a monopole configuration, a dipole configuration, or a beam configuration. The particular frequencies of operation are not limited by this disclosure, and can be adapted accordingly with the teachings of the disclosure. The antenna can resonate on two or more frequencies, and is not limited to those frequencies as described in the disclosure.

Having thus described the invention, what is claimed is:

1. Apex fed opposing swept element antenna including:

a. cylindrical fiberglass support;

b. two central tubular elements telescoping over said support;

c. end elements substantially perpendicular to said central elements and mechanically and electrically affixed to ends of said central elements;

d. upper and lower swept elements including securing means for mechanically and electrically connecting each of said upper and lower swept elements between each of said end elements and said central elements at a junction at said support, end to end separation of said central tubular elements being less than one-half wavelength; and, e. at least one stub means parallel to each of said central elements and electrically connected at each end of said stub means to each of said central elements and at a junction of said central elements.

2. Antenna of claim 1 wherein said stub means comprises at least one lower opposing stub positioned substantially parallel to a portion of said central elements, clamps connected between outer ends of said stub and a mid-portion of each of said central elements, an inductor-capacitor means connected between inner ends of said stub and inner ends of said central elements, and coaxial cable connected to a lower point of said inductor-capacitor means.

3. Antenna of claim 1 wherein said stub means comprises opposing first stubs positioned substantially parallel to a portion of said central elements, a shorting clamp connected between outer ends of said stubs and a mid-portion of said central elements, an inductor-capacitor means connected between inner ends of said stubs and inner ends of said central elements, and second opposing stubs positioned substantially parallel and below and shorter in length with respect to said first opposing stubs, a shorting clamp connected between inner ends of said first stubs and said second stubs, a capacitor means connected between substantially outer ends of said first and second stubs, and coaxial cable connected between a lower point of said inductor-capacitor means and the junction of said inner ends of said first and second stubs.

4. Antenna of claim 3 wherein said antenna is resonant on 10 meters, 15 meters and 20 meters.

5. Antenna of claim 3 wherein said inductor-capacitor means comprises a ceramic tubular capacitor and a coil.

6. Antenna of claim 5 wherein said coil comprises a hairpin inductor.

7. Antenna of claim 6 wherein said hairpin inductor comprises a loop of wire approximately eight inches long.

8. Antenna of claim 1 including a matching inductor connected across said feedpoint.

9. Antenna of claim 4 comprising a driven element and a reflector element spaced with respect to each other.

10. Antenna of claim 1 wherein said upper and lower elements are equiangular.

11. Antenna of claim 3 wherein said antenna is resonant on 12, 15, and 20 meters.

12. Apex fed opposing swept dipole element antenna including a cylindrical fiberglass rod support, a right and left central tubular element extending telescoped thereover and therefrom and secured thereto with nut-and-bolt assemblies, a right end tubular rod element and a left end tubular rod element secured at substantially a right angle to the outer ends of each of said central tubular elements and secured thereto with a nut-and-bolt assembly, upper and lower right swept rod elements and upper and lower left swept rod elements, each of said end rod elements and said swept elements being continuous, a clamp securing inner ends of the swept rod elements to an inner end of said central tubular element adjacent to said fiberglass rod support with a clamp and nut-and-bolt assembly, upper left and right first stubs, upper left and right shorting clamps at outer ends of said first stubs and secured between said outer ends of said first stubs and to a mid-portion of each of said central tubular elements with nut-and-bolt assemblies, right and left dielectric supports securing and supporting inner ends of said first stubs to an inner end of said central tubular element and secured thereto with clamps and nut-and-bolt assemblies, right and left tubular ceramic capacitor secured along with an inductance coil between and electrically connected to the inner end of said central tubular element and said inner end of said first stubs, and lower second right and left stubs, clamps between each inner end of said second stubs and said inner end of said first stubs, and right and left capacitors connected with wrap-around clamps and nut-and-bolt assemblies to outer ends of said right and left first and second stubs with bolts securing each of said capacitors to lips of said clamps, and a coaxial feedline including an impedance matching coil connected between feedpoints of said inner ends of said left and right first and second stubs.

13. Antenna of claim 12 further comprising a driven element and at least one other element spaced on a boom.

14. Antenna of claim 12 further comprising a driven element, a reflector element, and a director element, each formed from said apex fed opposing swept dipole element, and said driven element, said reflector element and said director element spaced and mounted on a boom.

15. Antenna of claim 14 wherein said elements operate on 14 MHz, 21 MHz, and 28 MHz.

* * * * *